United States Patent [19]

Nottingham

[11] 4,142,696

[45] Mar. 6, 1979

[54] GUIDANCE DEVICES

[75] Inventor: Ralph B. Nottingham, Towson, Md.

[73] Assignee: Novatronics, Inc., Pompano Beach, Fla.

[21] Appl. No.: 176,141

[22] Filed: Feb. 27, 1962

[51] Int. Cl.[2] ..... F42B 15/02

[52] U.S. Cl. ..... 244/3.16

[58] Field of Search ..... 244/14, 3.16; 102/3, 102/50, 51

[56] References Cited

U.S. PATENT DOCUMENTS

| | | | |
|---|---|---|---|
| 2,421,085 | 5/1947 | Rylsky | 244/3.16 |
| 2,935,942 | 5/1960 | Young | 102/3 |
| 3,000,307 | 9/1961 | Trotter, Jr. | 244/3.16 |

*Primary Examiner*—Verlin R. Pendegrass

*Attorney, Agent, or Firm*—Oltman and Flynn

EXEMPLARY CLAIM

1. In a missile guidance system, that improvement which comprises, a missile having a rotatable section, a fin on the section adapted to rotate the section as the missile passes through the air and to steer the missile when the cone section is braked, an optical slit on the section, an electrical generator rotated by the section, means responsive to radiation from a target received by said slit to short the generator, thus providing a brake on the section so that the fin will steer the missile toward the source of radiation.

15 Claims, 8 Drawing Figures

GUIDANCE DEVICES

The present invention relates to a guidance system for missiles.

There is at present a need for a low cost, light weight, self-contained and reliable target seeking guidance or orienting system for missiles, the term missiles encompassing torpedoes, depth charges, rockets, artillery projectiles, mines and similar explosive weapons.

It is, therefore, an object of this invention to provide an improved guidance system for missiles.

It is another object of this invention to provide an improved target seeking guidance or orienting system for missiles which is low cost, self-contained and reliable.

It is another object of this invention to provide a guidance system for missiles in which no major modifications of existing missiles is necessary.

It is a further object of this invention to provide a guidance system for missiles wherein a scanning and steering system on the missile reacts to stimuli emanating from a target so as to steer or orient the missile toward the target.

It is a more particular object of this invention to provide an optical scanning system for missiles wherein optical stimuli such as infrared radiation from a target is passed by an optical slit in a rotating element as the slit scans the target to activate a photosensitive sensor to produce a pulse. This pulse is amplified and controlled so as to apply an electrical load, such as a low resistance shunt, to a generator which is driven by the rotating element, thus applying a magnetic braking action to the rotating element. The rotating element carries or is coupled to an aerodynamic fin to cause rotation and a force acting in a direction tending to produce a desired missile orientation. As the rotary member is braked, the fin will cause the missile to veer in a desired direction.

It is a still further object of this invention to provide a missile guidance system in which the missile will be steered toward the target by reacting to sonic or ultrasonic stimuli.

It is a still further object of this invention to provide a missile guidance system in which the missile will be steered toward the target by reacting to detecting means using an optical system with photo elements for detection.

It is a still further object of this invention to provide a missile guidance system in which a missile has on it a rotatable section with means rotatable with said section to pass stimuli emanating from a target during that portion of each revolution when a part of the passing means lies in a plane formed by the longitudinal axis of the missile and the target. This stimuli sends a pulse to a steering means which will steer the missile in a direction formed by a line passing through the passing means and the target in response to the pulse.

Other and more specific objects of this invention will become apparent as the description proceeds when taken in connection with the accompanying drawings, illustrating preferred embodiments, in which.

Most military targets are a rich source of infrared radiation. Examples are fires, vehicular exhaust, guns, troop emplacements and other heat sources. It is this radiation that is used, according to one embodiment of this invention, to activate the guidance system whereby the missile is steered toward the target.

The guidance system may also take the place of present fuses and electrically provide arming and firing. However, presently developed types of fuses may be used in addition to the guidance system.

Figure 3:
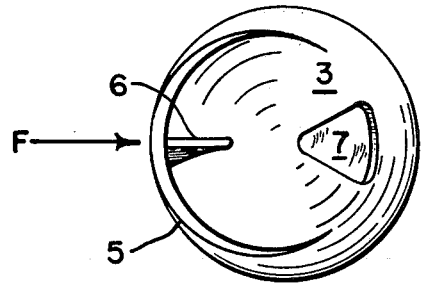
FIG. 3 is a front view of the mortar round.
Figure 1:
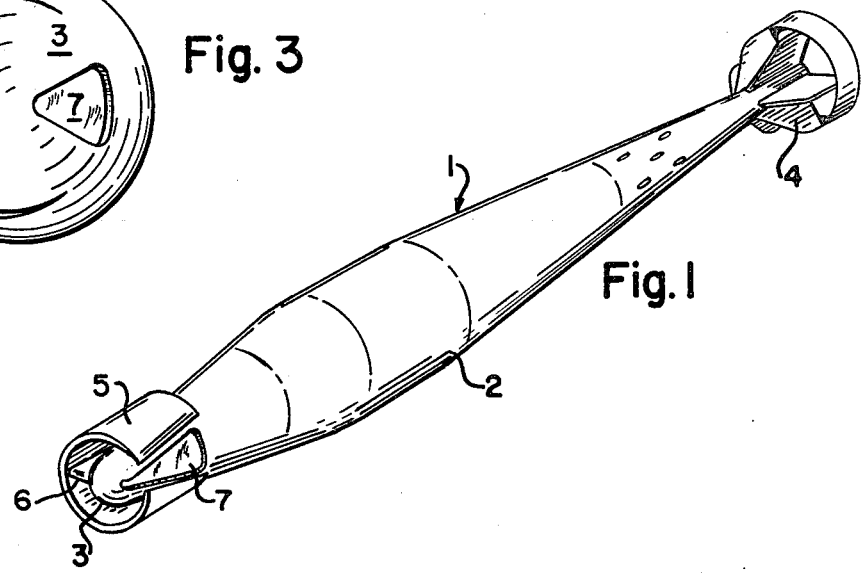
FIG. 1 is a perspective view of a mortar round constructed in accordance with this invention.

In FIG. 1, a mortar projectile 1 is shown which is conventional with the exception of the guidance system. The mortar projectile has a casing 2, a rotatable nose cone 3 and stabilizing structure 4. Positioned on the nose cone is a foil 5 supported on the nose cone by a strut 6. A scanning slit, positioned 180° from the median line of the foil, is shown at 7. The foil is an NACA (National Advisory Committee for Aeronautics) type foiled cowl. As seen in FIG. 3, a force in the direction of the arrow F occurs due to the air stream. The strut 6 is skewed to the longitudinal axis to produce the rotation. For example, in an 81-mm mortar round, charge 4 at 45°, there is an average speed of 115 meters per second on descent from apogee and a target slant angle of 30°. With a control surface of an NACA foiled cowl having a coefficient of lift of 1.2, a coefficient of drag of 0.07, and an effective area of 10 square inches, a lift force of 11.8 pounds develops. This results in an effective steering action for this type projectile.

Figure 2:
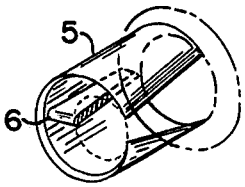
FIG. 2 is a cross sectional view of the nose cone.
Figure 2:
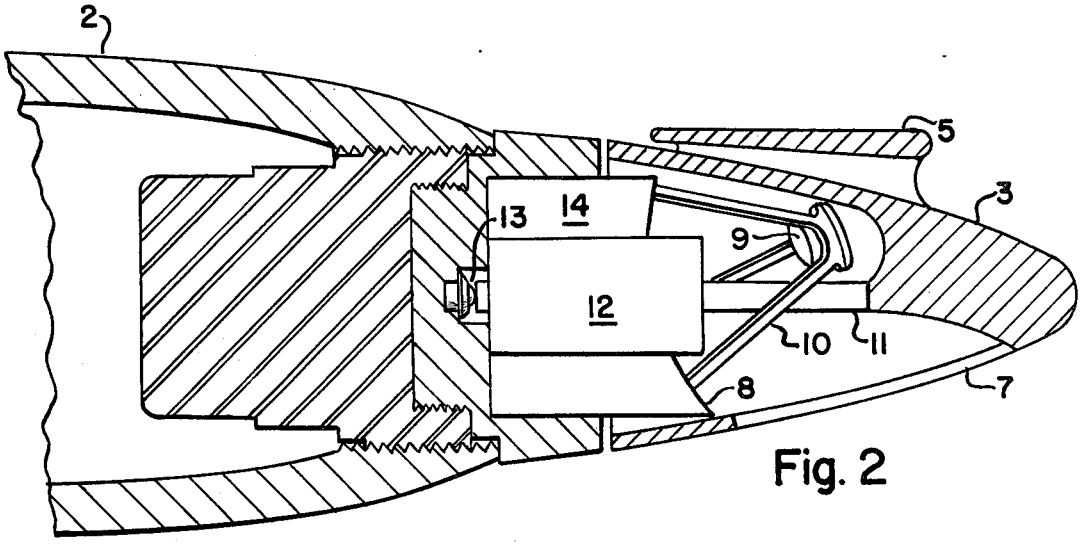

In FIG. 2, the construction of the nose cone is disclosed. The slit is shown at 7 and the foil at 5. 8 represents the mirror made of a high stability plastic having a coating of aluminum which is a first surface parabolic reflector so shaped and positioned as to encompass an angle of 30° from the projected longitudinal axis of the round. Therefore, as the optical slit is rotated, a scanning cone of 60° is generated. The radiation of any object in this cone is collected by the mirror and focused each time it is scanned onto a photosensitive detector 9 mounted on struts 10. It is placed off center so as to not interfere with the drive shaft 11. This detector is a conventional uncooled gold-doped germanium thermistor with a usable bandwidth up to 9 microns and with a noise-equivalent power of approximately $10^{-9}$ watts. This represents an absolute threshold for the system so that any target whose radiant intensity at the detector is at least one order of magnitude greater than this, say $10^{-8}$ watts, would provide sufficient information to control and guide the round.

Assuming the earth to be a black body with an emittance of 460 watts per square meter, a target one meter square and at a temperature of 500° F. would be ten times brighter than the background and would be sufficient to activate the detector.

Figure 4:
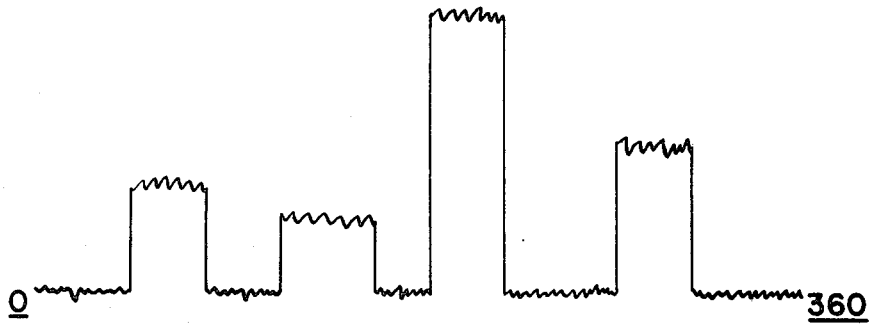
FIG. 4 is a diagram showing pulses emitted by the detector during a scan.

As the detector receives the radiation, it will put out a series of pulses which will vary in amplitude and duration as shown in FIG. 4 illustrating typical pulses received during one 360° scan. The amplitude of each pulse will depend on the strength of the radiation and the duration will depend on the size of the target and the angular distance of the target from the projected longitudinal axis of the bomb, with the duration increasing as the angular distance decreases.

Referring again to FIG. 2, there is shown a D.C. generator 12, the thrust bearing structure 13 and the driveshaft 11 connecting the nose cone to the generator armature. Reference character 14 generally refers to an encapsulated body of electronic devices to be referred to hereinafter for stability against the great forces encountered by acceleration of the projectile which is in the neighborhood of 16,000 g.

The generator is secured before firing by a shear pin (not shown) which will be sheared by setback due to firing. The generator is held immobile by end friction forces during acceleration, but on the cessation of acceleration, it is moved into operating position and permitted to rotate by the spring-loaded end thrust bearing 13.

Figure 6:
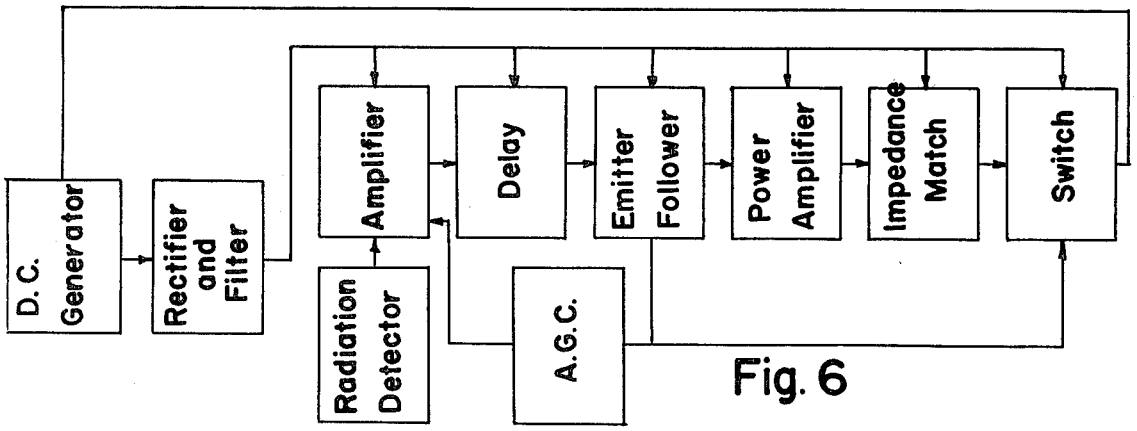
FIG. 6 is a block diagram of the electronics.
Figure 7:
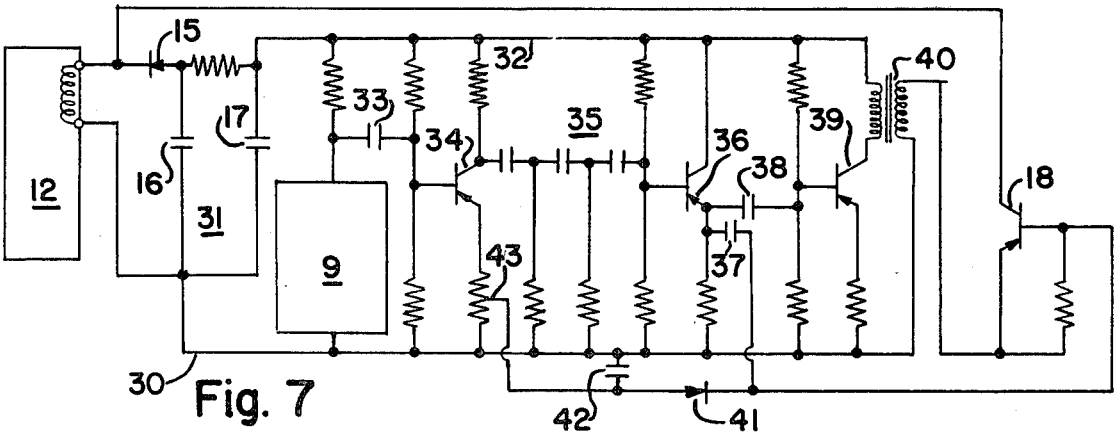
FIG. 7 is a schematic circuit diagram of the electronics.
Figure 8:
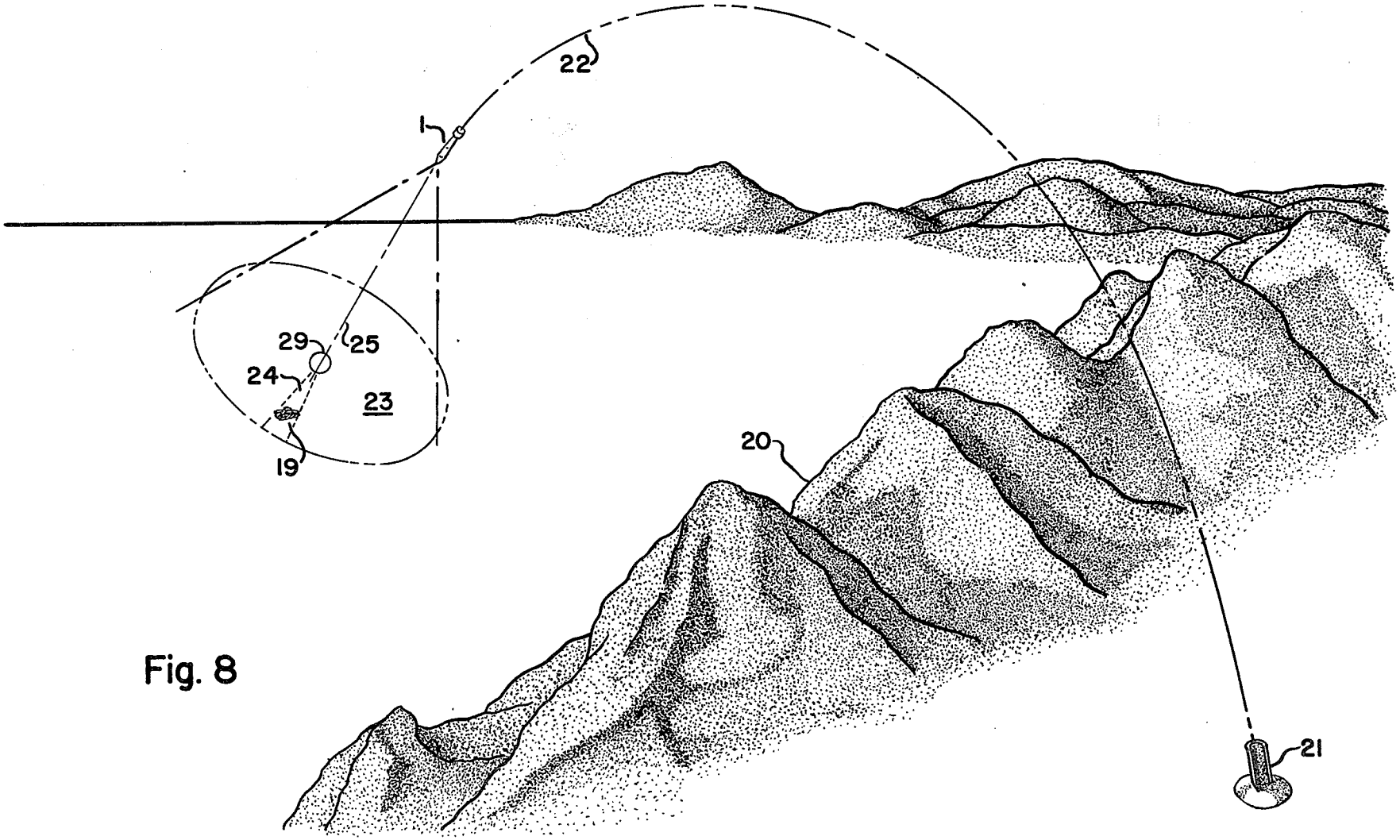
FIG. 8 is a diagram illustrating the operation of the mortar projectile.

The electronics are shown in FIG. 7 and the block diagram in FIG. 6. The D.C. generator 12 is a permanent magnet generator of very low moment of inertia. As the nose cone rotates, the generator will generate a voltage which is lead through the supply line 30 and the diode 15 which serves to prevent reverse current and charges the capacitors 16 and 17 of the filter 31. This serves to remove ripple from the DC output of the generator and applies essentially filtered DC to the line 32. The output of the sensor 9 is coupled through a capacitor 33 to the input of a transistor amplifier 34. Optionally, the output of the amplifier 34 may be fed to a standard delay network 35, if it is decided to apply the braking force in time delayed relationship to the position of the scanner when it receives a pulse. The time delay network feeds an emitter follower 36, the output of which is coupled through capacitor 37 to the base of the power switching transistor 18. The output of the emitter follower 36 is also coupled through capacitor 38 to a transistor amplifier 39 which energizes a step-up transformer 40, the secondary of which is interposed in the supply line 30 immediately ahead of the emitter and base connections to switching transistor 18.

An automatic gain control diode 41 is connected between a selected point 43 on the emitter impedance of the amplifier 34 and the base of transistor 18. A capacitor 42 connected between the tapped point of the impedance and the line 30 completes the automatic gain control network.

The purpose of the step-up transformer 40 is to apply braking to the DC generator by applying a motor voltage to its terminals and this may be omitted in which event the output of the emitter follower 36 will be connected only to the base of switching transistor 18, the transistor 39 and its associated circuity then being omitted. The step up transformer is also an impedance match.

Figure 5:
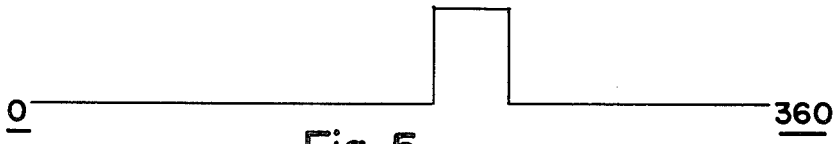
FIG. 5 is the output of the amplifier to the shorting device.

The automatic gain control (AGC) is incorporated so that after the first scan of the cone, the amplitude gain is reduced to the point that the highest amplitude input experienced will produce maximum amplifier output (FIG. 5). Any input below this amount will be essentially sliced out.

Although a reverse current pulse is used to brake the generator, a mere short circuiting can be used as less components are needed. However, the braking action is not as great as sending a pulse of reverse polarity.

The electronics, during shorting or reverse polarity, will be effected only to the extent that the average power delivered is reduced. In other words, the brief current interruption will not adversely affect the operation of the electrical components.

When the nose cone rotates freely the side thrust generated by the cowl 5 progresses around the longitudinal axis of the missile at a uniform rate; hence, the net effect thereof is zero and no guidance is imparted to the missile. When the system responds to target emanation a control pulse or signal generated by the number 9 triggers the electronic system to load the generator by short circuiting the same or by applying a motor current to the generator. Either of the foregoing generator loads increases the resistance against which the fin 6 is acting to rotate the nose cone and generator. The braking action of such loads slows the rate of rotation of the nose cone for the duration of the system response to target received emanation and, hence, produces an unbalance in the net side thrust of the foil 5 tending to steer the missile toward a selected target. It is apparent from the foregoing that the steering force is applied as a series of pulses corresponding to target induced pulses produced by sensor 9.

As an illustration of how the guidance system operates, reference is had to FIG. 9. The target, represented by 19, may comprise any source of infrared radiation such as a tank or gun. A mountain range indicated generally at 20 obstructs the view of the target from the firing point 21, making the guidance system particularly useful. On the descending phase of the trajectory 22, the projectile guidance system scans the target area. 23 represents the area visible to the system during a complete scan. 24 represents the scanning area at one position of the cone. 25 is the projected longitudinal axis of the projectile 1. It can be seen that the projectile is not on course, assuming for discussion purposes that the point at which the longitudinal axis meets the ground coincides with the point of impact without steering. When the target is not emitting radiation, the nose cone will rotate freely and not steer the projectile. However, when the target is in view as shown in FIG. 9, the detector will emit a pulse or pulses which will activate the electronics and the shorting device. Since the generator is shorted, a braking action on the nose cone and fin occurs which will steer the mortar due to a mechanical coupling of the cone and mortar. The term mechanical coupling is intended in this case to mean that caused by the shorting and not friction forces and small magnetic braking action normally present without shorting.

Since the fin is shaped so that a lift force perpendicular to the longitudinal axis of the projectile occurs during flight, and since the slit is pointing toward the target, a force is applied tending to steer the missile toward the target through the mechanical coupling. This is illustrated in FIG. 3 wherein F represents the direction of force.

When the target is no longer "seen" by the optical slit, the braking action is removed and the nose section rotates until the target is again visible to the optical slit. The steering action, however, brings the target closer to the projected longitudinal axis of the mortar with each revolution of the nose cone. This process continues until the target is in line with the longitudinal axis. At this point, the target "disappears" to the infrared guidance system as represented by the area 29 and the braking action is inoperative through the 360° rotation of the nose section. No further course deviation occurs since the aerodynamic steering force is equal in all directions.

It should be noted that when the missile is off course, a plane is formed by the longitudinal axis of the missile and the target. Actually, since the target is not a point, more than one plane is formed. However, it is simpler to consider the target as a point. The slit will pass radiation from that target only when a part of the slit also lies in that plane, i.e., when it "sees" the target. At this point the target, slit and a vector of force of the fin lie in the same line. Again, for simplicity, the slit is assumed to pass radiation only at that point although it is obvious that the slit may revolve a finite number of degrees and still pass radiation. Accordingly, when the slit lies in that plane, a pulse is generated which brakes the cone and fin causing a force to be applied in the direction of the target.

Although the above description is directed to one embodiment, other components may be utilized without departing from the scope of the invention. For example, the scanning angle could be made smaller or larger. Also, the slit, although preferably tapered, could be tapered in the opposite direction or could be rectangular. The actual shape is not critical. The detector could be any detector capable of emitting pulses such as the uncooled lead-selenide type.

Under certain conditions, it is desirable that the guidance system be selective in the target selection. For example, carbon dioxide has a molecular resonance at 4.3 microns. Due to this resonance, infrared transmission through the atmosphere is appreciably attenuated at this frequency so that sunlight, even spectrally reflected, has a relatively low energy content at this wave length. Conversely, when carbon dioxide is heated above ambient temperature, it will radiate most of its energy at this frequency.

An uncooled, gold germanium detector has decreasing sensitivity with increasing wave length but is sufficiently sensitive at 4.3 microns. For selective recognition of signals, a dichroic mirror which will be nonreflecting at wave lengths shorter than 4 microns is used in combination with the detector. The combined characteristics of the detector and mirror will give a tuned characteristic in the region of 4.3 microns. Accordingly, the system will be relatively insensitive to both shorter and longer radiation making the system essentially sensitive only to hot carbon dioxide. Inasmuch as aggregations of people, fires and vehicular exhaust are all sources rich in hot carbon dioxide, this will give an excellent target selection characteristic. In cases where it is desirable to have the nose cone of the missile rotate freely, unfettered by the generator upon firing, a releasable coupling (not shown) between the generator and nose cone is provided so that during set back the nose cone is permitted to rotate freely. When the generator is forced forward by the thrust driving spring the generator and nose cone are coupled. The generator will then be brought to operating speed after a delay and will be charged to operating potential. The round will then begin to scan and will see and hold a target after passing through the trajectory apogee. Sunlight will not ordinarily affect the guidance system as it cannot hold the projectile. The only time it is a significant factor is at sundown or sunrise and if the descending trajectory is pointed toward the sun.

The actual design of the air foil is not critical although it is necessary that the foil produce rotation and a lift vector perpendicular to the longitudinal axis and toward the target while maintaining stability. Any design of foil which will react with a medium having motion relative to the missile to produce rotation of the generator and side thrust on the missile will suffice for the purposes of this invention.

In underwater missiles, such as torpedoes and particularly depth charges, where radiation is appreciably attenuated, the guiding energy would preferably be sonic. In this case, the slit would be larger and would consist of a segment of high transmission material such as RHO—C rubber in a nose made of foamed material or other attenuating material. Instead of an infrared detector, a sonic transducer (or ultrasonic) is used and the mirror eliminated, the transducer receiving the sonic signal directly. The remaining components would operate in the same manner.

Although the embodiments discussed so far have been drawn to missiles in flight, it is evident that the same principles apply to an anchored missile, such as a depth charge or mine. In this case, orientation of the device would be accomplished by a current flowing past the device. For example, a mine could be anchored by a long line in a current of water and will orient itself by reacting to emanation from an approaching boat.

Instead of mounting the fin on the nose cone, it is within the scope of this invention to place the fin toward or at the rear in place of, or in addition to, the stabilizing fins. In such a construction, the driveshaft would extend rearwardly sufficient to be coupled to the fin. The steering action will be substantially the same although the lift vector will be oppositely directed. This will point the nose toward the target. Also the rear fin may be used in addition to the front fin.

Although preferable, it is not necessary that the scanner be placed at the front on the nose cone. The rotatable elements may be placed on the missile at any point. However, it is desirable to have fins either at the rear or at the front (or both) since the coupling action about the center of gravity of the missile is greater. In any event, the scanner is placed at a point where the target area is visible during rotation.

It is obvious that the principles of this invention are equally applicable to any projectile as well as bombs, mortar rounds and depth charges. In fact, any missile or device which is either in flight or subjected to a fluid current flow past the nose cone is adaptable to these principles.

While various particular embodiments of the invention have been shown, it will be observed by those skilled in the art that various changes and modifications may be made without departing from the invention in its broader aspects. Accordingly, the claims appended hereto are intended to cover all such changes and modifications as fall within the scope of this invention.

I claim:

1. In a missile guidance system, that improvement which comprises, a missile having a rotatable section, a fin on the section adapted to rotate the section as the missile passes through the air and to steer the missile when the cone section is braked, an optical slit on the section, an electrical generator rotated by the section, means responsive to radiation from a target received by said slit to short the generator, thus providing a brake on the section so that the fin will steer the missile toward the source of radiation.

2. In a missile guidance system as claimed in claim 1 in which the means for shorting the generator includes a photo sensitive sensor for receiving the radiation and adapted to send a pulse in response thereto, means for amplifying the pulse and means responsive to the amplified pulse for shorting the generator.

3. A guidance system according to claim 2 in which means for shorting further include a reflecting means for receiving the infrared radiation passing through the slit and reflecting said radiation on to the photosensitive sensor.

4. In a missile guidance system, a missile having a rotatable nose cone, a fin on said nose cone adapted to rotate the nose cone about the longitudinal axis of the missile and to steer the missile in a direction perpendicular to the longitudinal axis when the cone is braked relative to the missile, an electrical generator in the missile coupled to the nose cone, an optical slit on said nose cone positioned at an angle to said fin and in line with the direction of the steering force, a photosensitive element in said missile adapted to receive radiation passing through the slit and to send a pulse in response thereto, means to amplify said pulse and means responsive to said amplified pulse to send a pulse of reverse polarity to said generator, thus braking the generator, nose cone and fin so as to steer the missile toward the source of radiation.

5. A guidance system according to claim 4 in which the fin is an NACA foiled cowl mounted on a strut, the median line of the cowl being positioned 180° from the slit.

6. Means for guiding a missile toward an infrared radiation emitting source comprising, a rotatable nose cone, an optical slit on said nose cone and a fin on said nose cone adapted to rotate said nose cone when the missile moves through the air and to steer the missile in a direction perpendicular to the line of flight when the nose cone is mechanically coupled to the missile, an infrared sensor in the missile adapted to receive infrared radiation passing through said slit and to emit a pulse in response thereto, a generator coupled to the nose cone so as to rotate therewith and means responsive to said pulse so as to short the generator thus braking the generator and causing said mechanical coupling to provide a steering force to be exerted on the missile toward the source of infrared radiation.

7. A target seeking guidance system for missiles comprising, an element rotatable about the longitudinal axis of the missile having means to receive emanation from a target during a portion of each revolution of the element and air foil means adapted to rotate said element and to produce a steering action in the direction of the emanation receiving means, means responsive to emanation received by said receiving means to brake the action of the rotatable element so as to steer the missile toward the target in response to said emanation.

8. A guidance system according to claim 7 in which the emanation is infrared radiation.

9. A guidance system according to claim 7 in which the emanation is visible light.

10. A guidance system according to claim 7 in which the emanation is sonic vibrations.

11. A guidance system according to claim 7 in which the emanation is ultrasonic vibrations.

12. A target seeking missile guidance system adapted to be mounted on a missile comprising a sensor adapted to produce a control signal when subjected to a selected form of target emitted emanation, a scanning device mounted to rotate about the longitudinal axis of the missile and to pass such emanation originating from a portion only of a potential target area to the sensor whereby the whole potential target area is scanned progressively on each revolution of the scanning device, means to rotate the scanning device, steering means normally ineffective to steer the missile, means responsive to a signal produced by the sensor for activating said steering means to steer the missile toward a target while the sensor is receiving emanation from such target, and means operative following initial scanning of a potential target area for suppressing sensor signals induced by all scanned targets except the target emitting the maximum emanation.

13. A target seeking guidance system adapted to be mounted on a missile comprising target sensing means responsive to emanation of a predetermined character normally emitted by potential targets of a preselected type for generating a target signal whenever it receives emanation of such character, means facing forwardly of the missile and having a span of less than 180° circumferentially of the missile for passing such target emanation to said responsive means when the passing means directly faces a target and intersects a plane including the longitudinal axis of the missile and a target lying within a scanning cone of predetermined angle extending forwardly of the missile symmetrically about the projected longitudinal axis of the missile, means for rotating the passing means about the longitudinal axis of the missile to scan a potential target area and to pass all such emanation emitted by potential targets in said area as the passing means rotates, steering means operative when activated to apply a steering force to the missile steering control means responsive to target signals for activating said steering means for the duration of each target signal to apply a steering force to the missile in a direction to steer the missile toward the target emitting the emanation to which the sensing means is responding to generate a target signal, and target selection means for comparing all target signals generated during one revolution of the passing means and thereafter suppressing all but the strongest of such target signals whereby the missile is steered toward a single selected target.

14. Apparatus according to claim 13 wherein the missile has a rotatable nose cone and said passing means comprises a narrow slit in said nose offset from the longitudinal axis of the missile.

15. Apparatus according to claim 13 wherein said guidance system includes a rotatably mounted nose cone on the missile, said rotating means comprises an aerodynamic fin on the nose cone skewed with respect to the longitudinal axis of the missile, a generator is mounted on the missile to supply power to the system and is coupled to the nose cone to be driven thereby, said steering means comprises means rotatable with the nose for generating a net instantaneous side thrust on the missile by reaction with the air and means controlled by said emanation responsive means for applying a braking action to the generator for the duration of target emanation received by such responsive means to increase the time during which such side thrust is operative in a particular direction.

* * * * *